US005485919A

United States Patent [19]

Samberg et al.

[11] Patent Number: 5,485,919

[45] Date of Patent: Jan. 23, 1996

[54] CLAMSHELL PACKAGE AND PACKAGING SYSTEM

[75] Inventors: Steve Samberg; Barry Berger, both of New York, N.Y.

[73] Assignee: Nantucket Industries, Inc., New York, N.Y.

[21] Appl. No.: 323,510

[22] Filed: Oct. 14, 1994

Related U.S. Application Data

[63] Continuation of Ser. No. 205,351, Mar. 3, 1994, abandoned, which is a continuation of Ser. No. 23,773, Feb. 22, 1993, abandoned.

[51] Int. Cl.[6] ..... B65D 73/00

[52] U.S. Cl. ..... 206/461; 206/278; 206/470; 206/471

[58] Field of Search ..... 206/461, 463, 206/470, 471, 459.5, 485, 278; 220/4.22, 4.24, 4.25

[56] References Cited

U.S. PATENT DOCUMENTS

| | | | |
|---|---|---|---|
| 3,659,704 | 5/1972 | Collura et al. . | |
| 3,676,159 | 7/1972 | Fallowfield . | |
| 3,776,375 | 12/1973 | Rohdin . | |
| 3,837,476 | 9/1974 | Schwartz | 206/278 |
| 3,861,528 | 1/1975 | Damuth . | |
| 3,966,045 | 6/1976 | Perdue | 206/461 |
| 4,190,151 | 2/1980 | Russell . | |
| 4,240,552 | 12/1980 | Brown . | |
| 4,449,629 | 5/1984 | Barrieau . | |
| 4,619,364 | 10/1986 | Czopor, Jr. | 206/461 |
| 4,784,267 | 11/1988 | Gessler et al. | 206/459.5 |
| 4,807,747 | 2/1989 | Hadtke | 206/470 |
| 4,896,770 | 1/1990 | Calcerano et al. | 206/461 |
| 5,063,940 | 12/1991 | Adell et al. . | |
| 5,121,835 | 6/1992 | Grupe | 206/470 |
| 5,129,516 | 7/1992 | Theros . | |
| 5,143,215 | 9/1992 | Hartley et al. . | |
| 5,232,094 | 8/1993 | Fagnant et al. | 206/470 |

*Primary Examiner*—David T. Fidei
*Attorney, Agent, or Firm*—Saidman DesignLaw Group

[57] ABSTRACT

A package for a plurality of product items (such as intimate apparel) is made of transparent material. Two halves of the package are connected by an integral hinge. Each half is contour molded to provide distinct compartments for each of the product items and to provide a recess for retaining an insert in place within the package by the expansible qualities of the intimate apparel, without the use of adhesives. The packaging system is flexible to accommodate a wide variety of garments, quantities, styles, colors, patterns, sizes and brands. More particularly, the sculpture of the package and integrated insert shape provides the ability to differentiate at retail the garment style and fabric, all as a result of the geometry of the package.

39 Claims, 10 Drawing Sheets

CLAMSHELL PACKAGE AND PACKAGING SYSTEM

This application is a continuation of application Ser. No. 08/205,351, filed Mar. 3, 1994, now abandoned, which is a continuation of application Ser. No. 08/023,773, filed Feb. 22, 1993, now abandoned.

BACKGROUND OF THE INVENTION

1. Field of the Invention

This invention relates to packaging, and more particularly to a package and packaging system for storing and displaying goods for sale, specifically intimate apparel, in retail stores.

2. Description of Related Art

Retail packaging for intimate or personal apparel, such as men's, women's and children's underwear and swimwear, has in the past been provided in variations of two basic designs: (1) a box, usually having a body made of cardboard or opaque plastic, having an aperture which provides a window to the interior; and (2) a base box covered by a separate lid.

In the first type of package, the aperture or window is usually covered by attaching a piece of clear plastic film or forming to the interior of the container, an assembly requiring a complicated and costly manufacturing process. Use of an adhesive to attach the clear plastic likely renders the package non-recyclable. While the opaque body allows space for product identification (i.e., graphics), too often the product itself is poorly shown, leading customers to open the box to get a better look at what they are buying.

The lid of the second type of packaging can be made of transparent plastic, but being the top of the package and usually the prime location for a label, easy viewing of the package's interior is often obscured. The two-piece construction is also costly, as it requires separate manufacture of the lid and box and laborious assembly thereof. Further, the lid may need to be manually taped to the base box to keep it in place.

Three critical pieces of information must be communicated to the consumer at retail: (1) the pattern and color of the garments; (2) the number of garments that are in the package; and (3) the size of the garments that are in the package. If any of these pieces of information are not visually apparent by a mere inspection of the package, the consumer, often mistrusting of mere graphical information, will open the box to inspect the goods herself.

Unfortunately, both of the above-described prior art packaging variations for intimate apparel do not visually communicate this information very well and, in addition, are easily openable. While possibly damaging the package, easy opening thereof also permits switching or simple pilfering of the product. For instance, if the intimate apparel comprises an assortment of differently colored men's briefs, a person may prefer one color rather than another. If the package is easily openable, selected briefs can be transferred to a single package. This leaves behind a lesser selection for the next customer, resulting in the likelihood that the package will not be bought. It eventually will be considered as "damaged goods" by the store manager to be returned to the manufacturer or disposed of.

Also, when a package having a plurality of products therein is easily openable, such as the above example of a plurality of men's briefs, one brief can be removed from the package, stuffed into a pocket or bag, and stolen. The package left behind is defective, and, again, eventually becomes "damaged goods", to say nothing of the loss of stolen merchandise.

Further, opening the package often damages the package itself, and since most people are reluctant to buy intimate apparel which have been previously opened (even when they were the first to open it), the package and product become "damaged goods" which are no longer salable. The removal of "damaged goods" is a major source of financial loss for the store and the manufacturer. In the first place, the value of the product, including the costs of its manufacture, shipping, and handling, is lost, since the expense of returning the damaged goods to the manufacturer may be more than the product is worth. Also, someone must be paid to file the necessary paperwork crediting the store for the value of the damaged goods and to physically remove the product. Even further costs are incurred due to the time it takes for personnel, both the store's and manufacturer's, to process the paperwork.

Another drawback of previous packages is that the product is often merely stuffed therein, or restuffed by an inquisitive potential customer, thereby wrinkling clothes or possibly damaging other, more solid items.

In addition, most boxboard packages require an "add on" plastic hook for attaching the package to a merchandising peg rack for display and dispensing. To avoid this purchase and/or labor expense, many manufacturers attempt to die cut, score and fold the top flap of the box to try and incorporate a hook, but such constructions have proven to be ineffective.

A still further drawback of the prior art packaging for intimate apparel is that the boxes are geometrically indistinguishable from one another. That is, the boxes of the prior art are all rectangular solids, and information concerning the brand, varied styles, fabric content and sizes must be printed on each box. This makes it difficult for non-English speaking customers, as well as those customers unfamiliar with the product category, to select what they want, leading to more boxes being opened prior to purchase. Since the boxes are geometrically indistinguishable, many customers pick up several boxes to choose from, and after selecting one will likely place the remaining boxes back on the dispensing display at a random location, making it difficult to keep any semblance of order on the retail shelf. It also makes it much more difficult for stockkeeping personnel, who possibly may not be fluent in English, or familiar with the products' variations, to maintain the stock at the retail level, since it is far too easy to mix up boxes which only differ by what's printed on them.

OBJECTS AND SUMMARY OF THE INVENTION

It is therefore a principal object of the present invention to provide a package which overcomes and obviates the above disadvantages.

It is another object of the present invention to provide a package which is easily and inexpensively manufactured, loaded and assembled.

Another object of the present invention is to provide a package whose use at retail is flexible.

A main object of the present invention is to provide an attractive, flexible package which cannot be easily opened by the consumer in the store prior to purchase.

It is a further object of the present invention to provide a package which can be easily and effectively displayed in a retail store.

It is a still further object of the present invention to provide a retail package which is mainly transparent, front, back, and sides, so the consumer can easily see the pattern and color of the product as well as the quantity of the product in the package.

It is a further object of the present invention to provide a package which has features that minimize the possibility of the package and/or its contents becoming "damaged goods".

Another main object of the present invention is to provide a package which incorporates a flexible system to enable the consumer and stock clerk to easily differentiate style, color, quantity, fabric and size without requiring reading of words on a label.

A further object of the present invention is to provide an improved package for presentation of intimate apparel which permits quick and easy style, color, quantity, fabric and size differentiation without requiring numerous structural or full mold change.

A still further object of the present invention is to provide a package for intimate apparel which incorporates an integral peg hanging device that works.

Another object of the present invention is to provide a package for intimate apparel which provides areas for attaching the retailer's own adhesive labels without obscuring or lessening any of the differentiation capabilities of the package.

A still further object of the present invention is to provide a package for intimate apparel in which the front of the package and the back of the package (whose two faces may not be the same) can be selected after the package shell has been manufactured, that is, either half of the package may serve as the front or back as may be desired.

Another object of the present invention is to provide an intimate apparel package which is fully recyclable.

A still further object of this invention is to provide a package design which greatly facilitates and simplifies stockkeeping and restocking at the retail level.

The foregoing and other objects are achieved in accordance with one aspect of the present invention through the provision of a package for a plurality of pairs of intimate apparel which comprises a first half and a second half each having an integral flange extending about the periphery thereof and being integrally connected to each other along one edge by an integral hinge. Each of the package halves comprises a dished-out portion having a product-receiving portion and a insert-receiving recess overlying the product-receiving portion. The insert-receiving recess preferably includes a preselected peripheral contour. The present invention further contemplates the provision of an insert comprising a front flap, a back flap, and a side flap integrally connecting the front flap and the back flap. The insert is preferably positioned within the recesses of the first and second halves without being adhesively secured therein. The insert is adapted to be retained in the recesses by the engineered and tested expansion of the plurality of pairs of intimate apparel that have been previously rolled and/or folded and are contained within the package when the first and second halves are closed. The package is preferably molded of a transparent, semi-flexible plastic material.

In accordance with another aspect of the present invention, the front and back flaps of the insert have preferably the same general shape as the insert-receiving recesses in the first and second halves of the package, respectively. In addition, the front and back flaps of the insert may be shaped similarly to one another, such as semi-circular, triangular, rectangular, or polygonal. Alternatively, the front and back flaps may comprise a portion of a rectangle and a polygon, or a portion of a rectangle and a circle. The polygon may, in one embodiment, comprise a square. The back flap may be 180° rotated with respect to the front flap.

In accordance with another aspect of the present invention, the front and back flaps of the insert may be shaped differently from one another. For example, the front flap may comprise a portion of a rectangle and a square, while the back flap may comprise a portion of a rectangle and a triangle.

In accordance with another aspect of the present invention, means are provided for differentiating between a plurality of styles of product for the package. The differentiating means preferably comprises a plurality of inserts each having a plurality of different shapes, respectively, for the front and back flaps thereof, wherein each of the different shapes represents a different style of product. The differentiating means may further comprise a plurality of differently-shaped recesses in the first and second halves of the package, the recesses being shaped to accommodate the differently-shaped front and back flaps of the plurality of inserts.

In accordance with yet another aspect of the present invention, means may be provided for differentiating between a plurality of sizes of product for the package, the differentiating means comprising selecting one of a plurality of colors to display on the flaps of the insert, each of the colors representing a different size.

In accordance with another aspect of the present invention, means may further be provided for differentiating between a plurality of fabrics for the product, the differentiating means in this case including means for selecting either the first half or the second half of the package as the front of the package. The selecting means in a preferred embodiment comprises a reverse J-hook formed on a header portion of the integral flange.

In accordance with yet another aspect of the present invention, the product-receiving portion preferably comprises a plurality of segments for separating and retaining the plurality of pairs of intimate apparel. The latter are preferably individually folded and/or rolled prior to insertion into the package. The plurality of segments resemble a plurality of juxtaposed barrels, whereby each of the barrels receive, separate and support one of the pairs of intimate apparel.

In accordance with another aspect of the present invention, there are further provided a pair of feet, one of each of which is molded into the first and second halves, respectively, along both sides of the hinge, such that the package may be stood upright on a support surface. The flanges of the first and second halves are preferably heat-sealed, for example, by radio frequency sealing, and then are die-cut.

In accordance with another aspect of the present invention, the peripheral contour of each of the recesses includes a side edge that is contiguous with a side wall of the first and second halves, and the recess has a geometrical shape selected from the group consisting of rectangular, semi-circular, triangular, and polygonal. The side flap more particularly lays adjacent the side walls of the first and second halves when closed, and the periphery of each of the front and back flaps preferably correspond to the peripheral contour of the recesses.

In accordance with another aspect of the present invention, a system is provided for packaging a plurality of pairs of intimate apparel of various styles, colors, sizes and fabrics, which comprises a first half and a second half molded of a transparent, semi-flexible plastic material. Each of the halves comprises a dished-out portion having a product-receiving potion and an insert-receiving recess overlying the product receiving portion. Means are provided for differentiating between a plurality of styles of product to be packaged, the differentiating means comprising a plurality of inserts each having a plurality of different shapes, respectively, that represent different styles of product to be In accordance with yet another aspect of the present invention, a package is provided which is molded of a transparent, semi-flexible plastic material for housing a plurality of pairs of intimate apparel, which comprises a first half and a second half connected to each other along one edge by a hinge, and means for selecting whether the first or the second half of the package is the front of the package. The selecting means comprises in a preferred embodiment a reverse J-hook formed on a portion of a flange which is integral with and extends about the periphery of the first and second halves.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
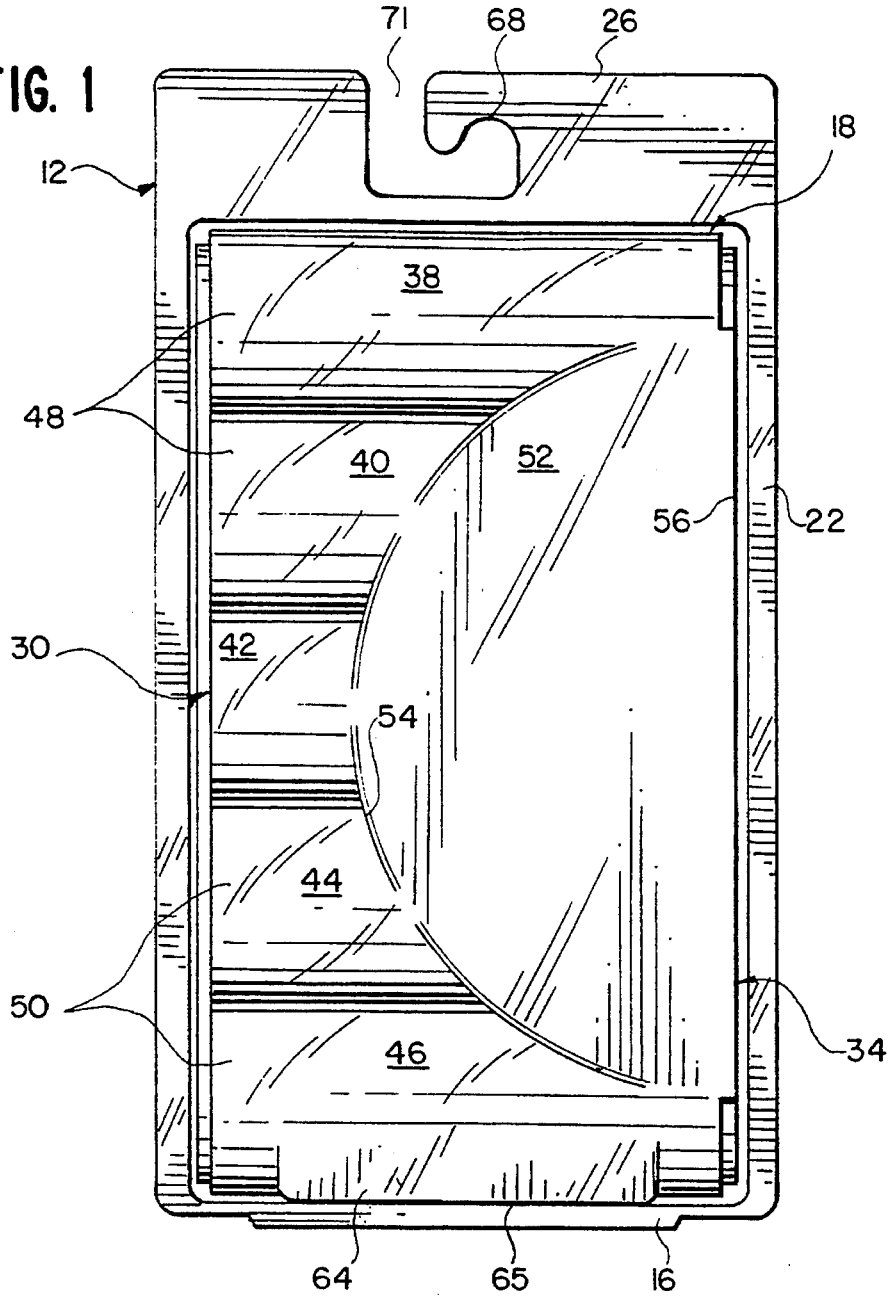
FIG. 1 is a front view of a preferred embodiment of a clamshell of the package of the present invention.
Figure 2:
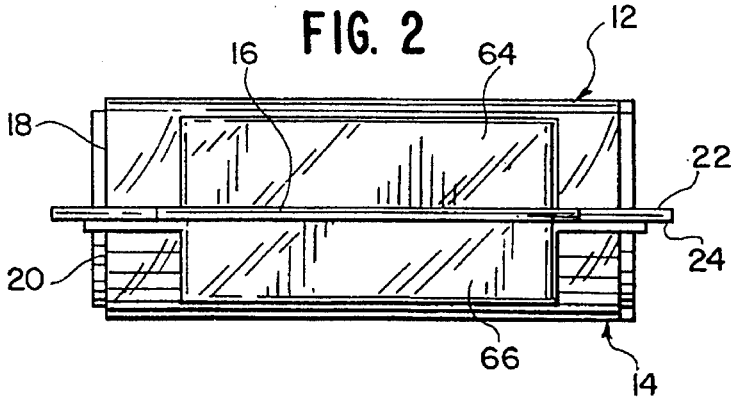
FIG. 2 is a bottom view of the embodiment shown in FIG. 1.

Referring now to the drawings, wherein like reference numerals represent identical or corresponding parts throughout the several views, and more particularly to FIGS. 1 and 2 thereof, reference numeral 10 indicates generally one preferred embodiment of a package in accordance with the present invention for holding a retail product for display and sale. The preferred product is intimate apparel, such as for example an assortment of men's fashion briefs of different colors and styles, and the following detailed description will proceed with that in mind. It should be understood, however, that other intimate apparel, such as for example women's and children's underwear, or swimwear for men, women and children may be utilized with the package and packaging system of the present invention.

Package 10 is preferably pressure formed of a semi-flexible, clear, thermoplastic material which has been extruded in sheet form. Pressure forming uses two molds to minimize stretching and to provide precise dimensioning. Since pressure forming control reduces thinned-out surfaces, an overall lighter gauge sheet may be used without the risk of breaking the surface of fragile parts. The invention is not limited to this method of manufacture, however, since obviously other methods may be used.

Package 10 comprises first and second halves 12 and 14 which are joined at one end by an integral hinge 16 in clamshell fashion. By employing a clamshell design, each package is molded in a single step, thereby reducing the costs of molding as well as the costs of assembly. In this particular embodiment, the first half 12 is essentially a minor image of the second half 14, relative to hinge 16. However, as will be appreciated by the description that follows, it is not necessary that the first and second halves of the clamshell of the present invention be mirror images.

Referring to FIGS. 1–4, each half 12 and 14 comprises a dished-out portion indicated generally by reference numerals 18 and 20. The dished-out portions 18 and 20 are each surrounded by a respective peripheral flange 22 and 24. The width of flanges 22 and 24 is relatively narrow, except for the width of the header portions 26 and 28 which are enlarged to accommodate retailer's adhesive labels, and for another purpose which will be described in greater detail below.

Flanges 22 and 24 are shaped to form complimentary fitting and interlocking ridges and grooves (not specifically shown), so that the two halves 12 and 14 can be snapped together to hold the package in its closed condition at least temporarily for loading and assembly convenience. This overcomes the garment's expansibility until sealing.

Dished-out portions 18 and 20 are shaped to accommodate folded and/or rolled products (e.g., men's underwear) and an insert for package differentiation and product identification, as will be described in greater detail hereinafter.

Dished-out portions 18 and 20 each have two major areas: product-receiving recesses 30 and 32 respectively, and insert-receiving recesses 34 and 36, respectively. The insert-receiving recesses 34 and 36 overlay a potion of the product-receiving recesses 30 and 32, respectively.

The product-receiving recess potion 30 comprises barrel-shaped cylindrical recesses which in this embodiment include five barrels 38, 40, 42, 44 and 46 which are each designed to receive one pair of folded and/or rolled garments, e.g., men's underwear. In this embodiment, as a result of package half 14 being a mirror image of package half 12, product-receiving recess portion 32 also includes five similar and opposing barrels to barrels 38–46 of package half 12.

Figure 6:
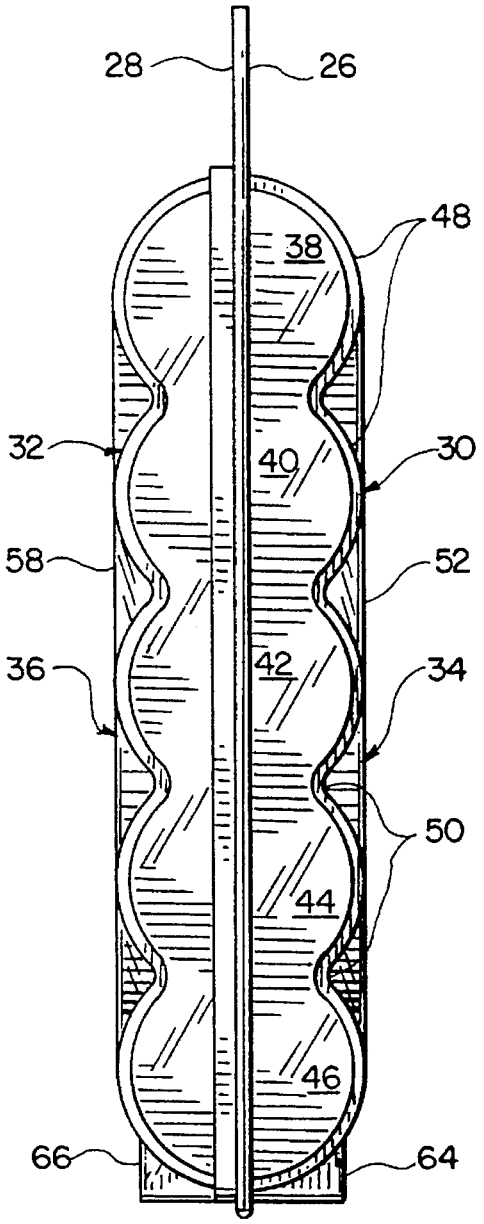
FIG. 6 is a left side view of the embodiment shown in FIG. 1.

Barrels 38–46 include concave portions 48 connected by convex portions 50 which divide adjacent compartments in the product-receiving recesses 30 and 32, as perhaps best viewed in FIG. 6. The opposing barrels in package half 14 includes similar structure.

Each barrel is sized to receive, support and separate a single garment. Prior to insertion into the package, each garment is preferably folded and/or rolled in such a manner that the pattern and color are clearly visible. Further, although five barrels are shown in this embodiment for accommodating five pairs of garments, it is readily apparent that a different number of barrels can be selected to display either more or fewer pairs of garments. In addition, such garments come in multiple sizes (e.g., small, medium and large) and styles (e.g., fly front, low rise, bikini). Different sizes and styles of garments have differing mounts of fabric material, and therefore occupy different volumes. The size of a given package of the present invention has been optimized to accommodate several different sizes and styles of garments.

Referring back to FIGS. 1 and 2, the insert-receiving recess 34 has a flat outer surface 52 and may be provided in any desired size or shape. The desired size and shape of insert-receiving recess 34 may be achieved by placing preselected inserts in the mold for package half 12. If the size and shape of recess 34 is desired to be changed, it is simply a matter of changing the inserts in the mold, rather than the mold itself, thereby further contributing to economy and flexibility.

In this particular embodiment, flat outer surface 52 is in the form of a semi-circle 54 having a side edge 56 which is contiguous with a side wall 57 (see FIG. 5) of the product-receiving recess 30.

Figure 3:
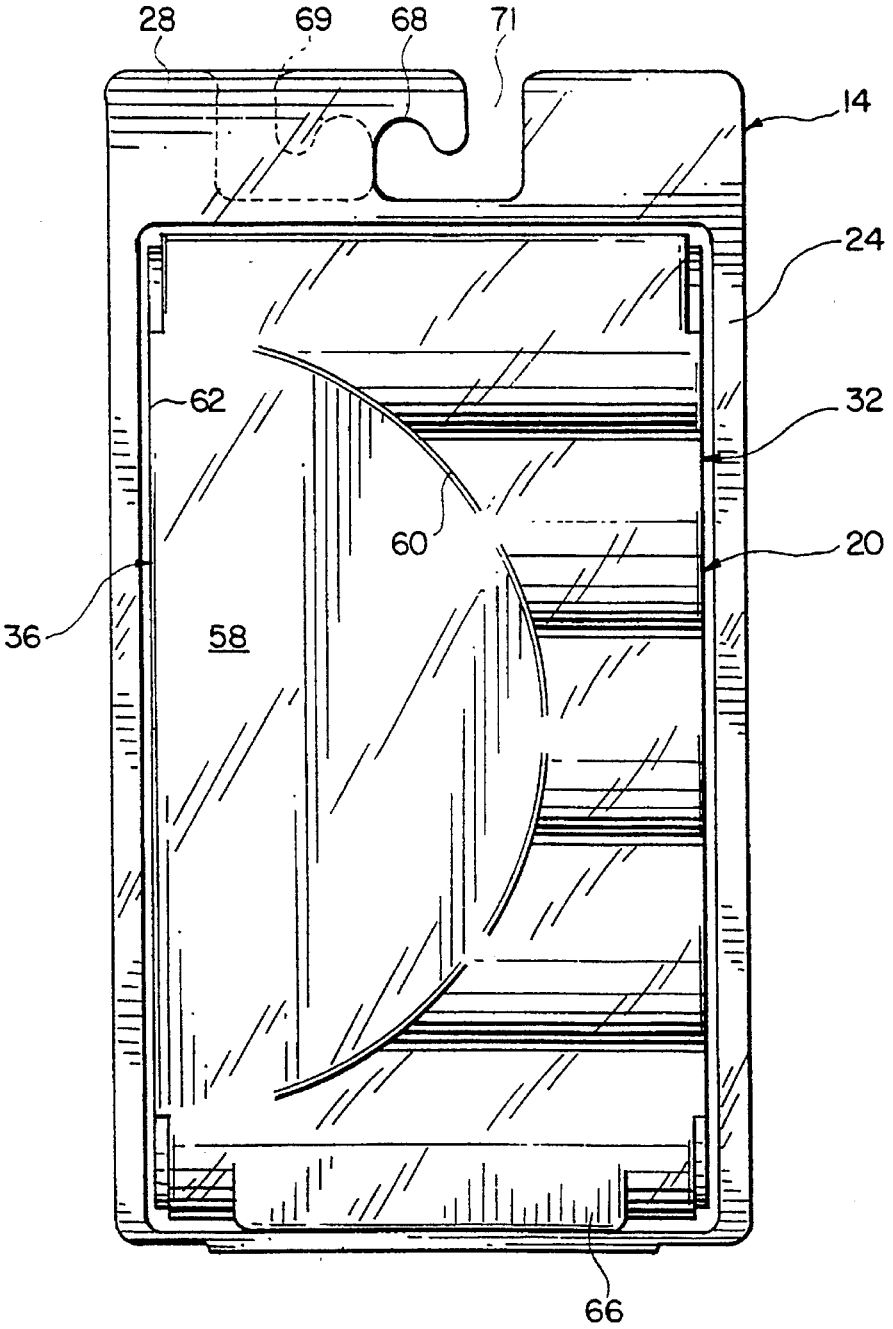
FIG. 3 is a back view of the embodiment shown in FIG. 1.
Figure 4:
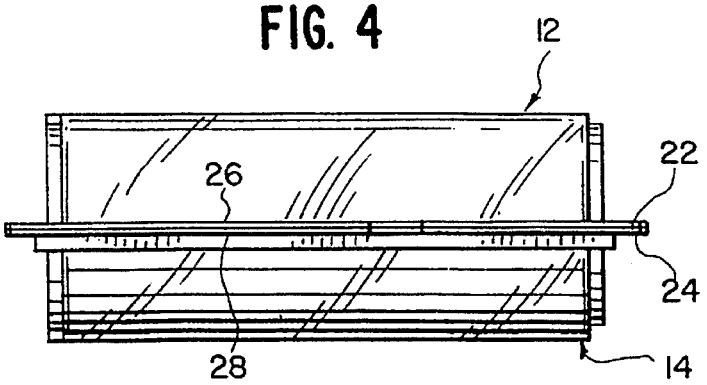
FIG. 4 is a top view of the embodiment shown in FIG. 1.

Similarly, referring to FIG. 3, insert-receiving recess 36 has a flat outer surface 58 which may also be formed of any desired size or shape. In this embodiment, surface 58 is formed as a semi-circle 60 having a side edge 62 which is contiguous with a side wall 63 (see FIG. 5) of the product-receiving recess 32.

Figure 5:
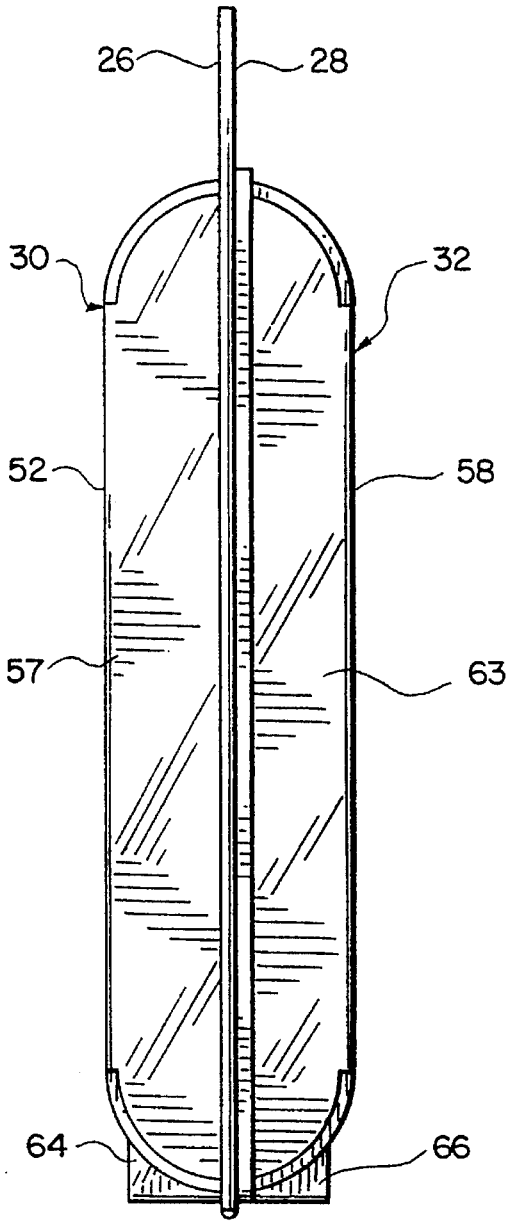
FIG. 5 is a right side view of the embodiment shown in FIG. 1.

Briefly referring to FIG. 5, it may be appreciated that the side wall 57 of product-receiving recess 30 is preferably coplanar with the side wall 63 of product-receiving recess 32. Thus, coplanar side walls 57 and 63 form a window through which a side flap of a printed insert, to be described in greater detail below, may be easily and readily observed.

In FIG. 6, it may be seen that the planes of outer surfaces 52 and 58 are preferably slightly above a plane tangent to the outer surface of product-receiving recesses 30 and 32, respectively. In FIG. 1, it may also be seen that the convex and concave surfaces 48 and 50 of the product-receiving recess 30 extend to their intersection with the semi-circular periphery 54 of outer surface 52, giving the impression that they are separate product-containing tubes which continue under surface 52. The visual separation of products, which occurs in a similar manner on the other half 14, makes for a neat, orderly display which is aesthetically pleasing and reassuring to the consumer with respect to content and quality, all of which encourages acceptance and purchase of the product.

Figure 11:
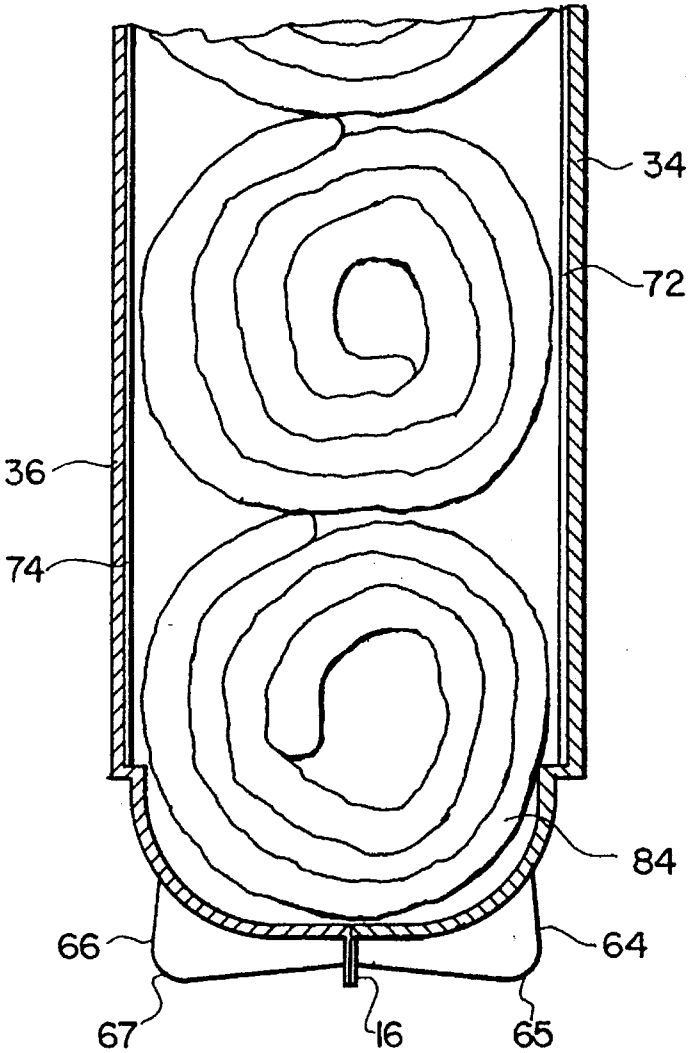
FIG. 11 is an enlarged, partial cross-sectional view of a closed package with a product and insert therein in accordance with the present invention.

Integrally molded on one end of dished-out portions 18 and 20 are a pair of feet 64 and 66. Foot 64 is preferably transversely inclined downwardly and outwardly from hinge 16 (see FIG. 11) before turning back at rounded edge 65 to join the bottom of the package. As seen in FIGS. 1 and 2, rounded edge 65 of foot 64 extends laterally along a major portion of one end of dished-out portion 18. Foot 64 coacts with foot 66 formed in a similar location on package half 14 to provide a stable base for package 10. This permits package 10, if desired, to stand upright (as viewed in FIG. 1) on a retail shelf for display, thereby occupying a small area on the shelf. In this manner, a large number of packages may be stably placed in a single facing on the retail shelf. As seen in FIG. 11, a plane including both rounded edges 65 and 67 preferably either includes or is slightly displaced from hinge 16 so that the rounded cross-sectional shape of hinge 16 does not impede the standing of the package on its feet.

Package 10 is sealed in a manner that will be described in greater detail below. Upon sealing package 10, a J-shaped notch 68 (FIG. 1) is simultaneously die-cut into header portions 26, 28. J-shaped notch 68 provides flexibility in displaying package 10 in a retail store; namely package 10 can be hung from an outwardly extending peg or stood upright on its feet 64, 66 as previously described. Furthermore, provision of a J-shaped notch 68 with an open end 71 permits a misplaced package to be easily taken from one position on a peg and reinserted into its proper position without having to remove all of the other packages.

The J-shaped notch 68 performs another important function in the packaging system of the present invention. That is, the direction and orientation of the J-shaped notch 68 defines which side of the package is the front and which side is the back. For example, when the J-shaped notch 68 is reversed (shown in FIG. 1), package half 12 is deemed to be the front of the package 10. In such an event, the J-shaped notch 68 will appear as seen in FIG. 3 on the other half 14 of package 10. However, when it is desired to have the second half 14 serve as the front of package 10, then the J-shaped notch will be die-cut in the position indicated in dotted lines and by reference numeral 69 in FIG. 3. In this manner, it is clear that either half 12 or 14 of package 10 may serve as the front of the package, as may be desired. Note that at the point of purchase, all J-hooks face the same way. In addition to the direction and orientation of the J-shaped notch, the front of the package may-be further defined by printed graphics on an insert, to be described in greater detail below.

Figure 10:
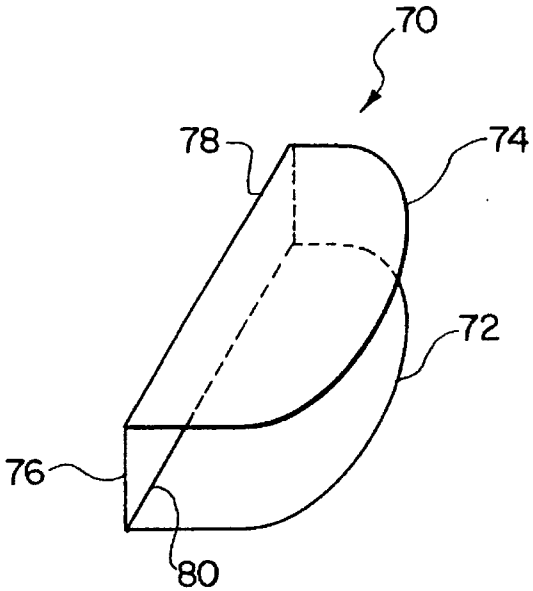
FIG. 10 is an isolated perspective view of one embodiment of an insert in accordance with the present invention.

Referring now to FIG. 10, an insert in accordance with one embodiment of the present invention is indicated generally by reference numeral 70. Insert 70 includes a front flap 72, a back flap 74, and a side flap 76 which connects front flap 72 and back flap 74. A pair of fold lines 80 and 82 facilitate flexing of the front and back flaps 72 and 74. In this embodiment, from and back flaps 72 and 74 are shaped similarly to one another, and are in the form of semi-circles. As will become apparent below, it is not necessary that the front and back flaps be shaped the same as each other, nor that they be mirror images. It is important to differentiate between the front flap and the back flap since graphic information is normally printed on the front flap 72, the back flap 74, as well as the side flap 76 as will be described.

Figure 7:
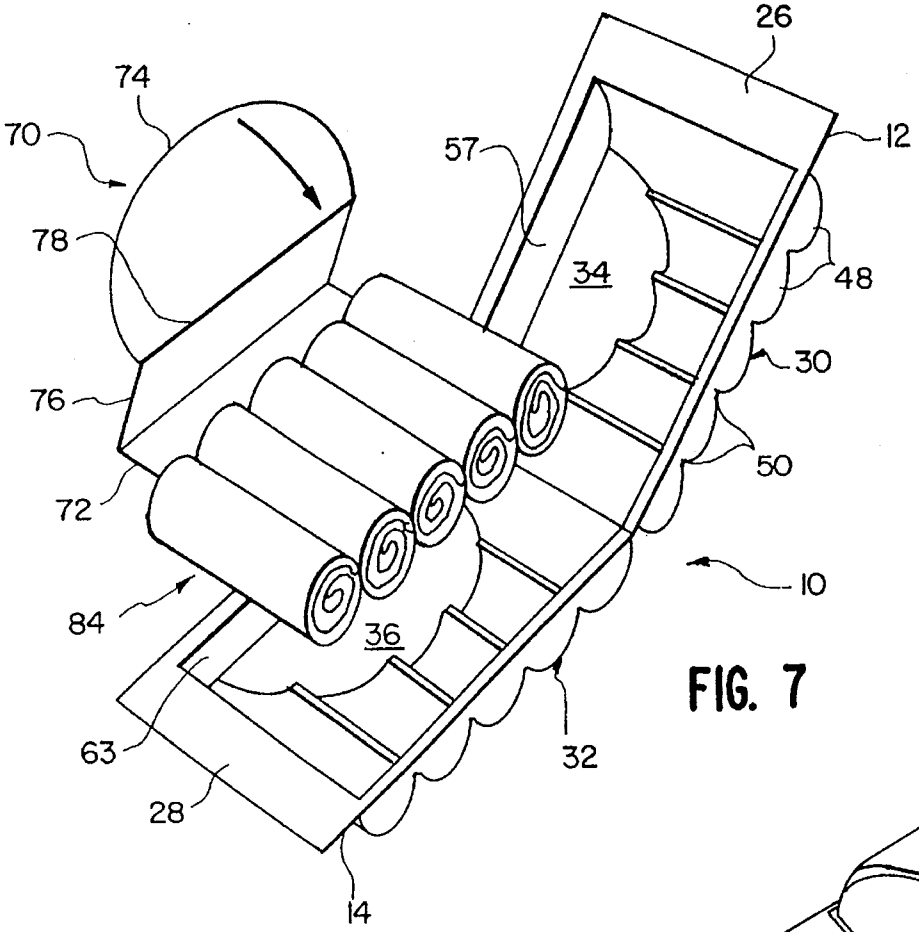
FIG. 7 is a perspective, exploded view showing a preferred embodiment of the components of the present invention just prior to assembly.

FIG. 7 is an exploded view illustrating the placement of insert 70 and products 84 in package 10. In this embodiment, products 84 comprise a plurality (e.g., 5 pair) of folded and/or rolled intimate apparel, such as men's briefs. With package 10 hinged open as shown, in clamshell fashion, front flap 72 of insert 70 is placed within recess 36 of half 14; side flap 76 rests against side wall 63. An assortment of folded and/or rolled garments 84 are placed on top of front flap 72 of insert 70 in the semi-cylindrical segments produced by the convex and concave barrel surfaces 32. Back flap 74 is then folded over the garments 84 along fold line 78 in the direction indicated by the large arrow in FIG. 7. Finally, the other half 12 of package 10 is hinged downwardly (along hinge 16, not shown) to close the package. At this point, back flap 74 of insert 70 rests within recess 34, and side flap 76 is adjacent both side walls 57 and 63.

Insert 70 remains in its proper orientation relative to package 10 and its contents by virtue of recesses 34 and 36, side walls 57 and 63, as well as garments 84. When garments 84 are folded and/or rolled up prior to insertion into package 10, they contain a certain amount of expansibility. The volume expansion of the garments 84, which takes place after they are placed within the package, greatly assists in maintaining insert 70 in its proper position in the package without requiring adhesives. The lack of adhesive is a great advantage of the present invention, since it renders the package 10 recyclable. The expansibility of the garments also permits a package having a particular internal volume to accommodate different sizes of garments in numerous different configurations. For a given internal volume, each different size and style of garment must generally be rolled and/or folded differently so that the resulting expansibility is the same. The particular rolled and/or folded configuration must be engineered and tested to ensure the desired results.

Clearly, insert 70 may accommodate a wide variety of printed matter and graphics. These can be varied to indicate different brands, styles, sizes and/or fabrics. This provides a given embodiment of clamshell package 10 with great flexibility, since only a different printed insert need be utilized to differentiate between the contents.

In addition, since insert 70 is located inside package 10, it cannot be soiled or damaged during shipment and handling of the packaged product, thereby removing another common source of "damaged goods".

The two halves 12 and 14 of package 10 are ultimately sealed by any applicable method, by radio frequency sealing, for instance. The aforementioned interlocking ridges and grooves in flanges 22 and 24 hold package 10 closed in preparation for sealing. Sealing occurs along all edges except the hinged edge 16. Unauthorized entry into the package, switching of selected briefs from one package to the other, and pilfering of selected briefs are effectively prevented by the sealing of package 10.

Figure 8:
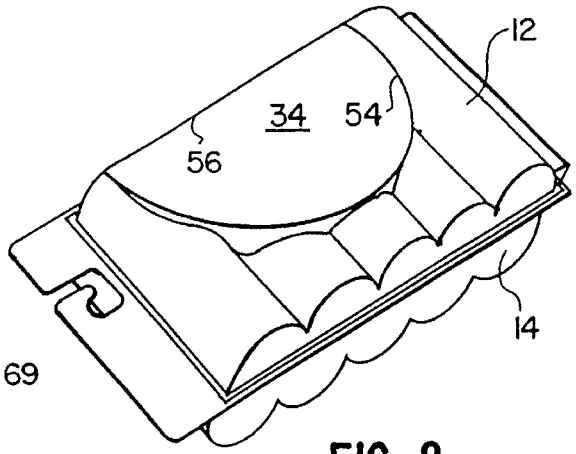
FIG. 8 shows the package of FIG. 7 in its closed, assembled condition.

In use, the printing on insert 70 will reinforce the designation of one of the halves 12 and 14 as the front half. Since the J-hook 69 appears reversed on half 14, the latter is the "front" of the package 10 in the example illustrated in FIGS. 7 and 8. The portion 72 of insert 70 which is seen through the "front" half 14 will therefore ordinarily have the principal advertising text printed thereon, e.g., a photo or sketch of the garment being worn by a model, a licensed logo, the product name, and any other pertinent information. The back flap 74 might have printed thereon a UPC code, identification of manufacturer or licensee, washing instructions, and/or environmental information which might be useful to the consumer. The side flap 76 could show a size chart, country of origin, style number, and a description of advantageous features. Clearly, because there is a choice available for orientation of text, slightly different but related products can be differentiated visually at least in part by inserts which are printed such that either the half 12 shown in FIG. 1 or the half 14 shown in FIG. 3 is the front face of the package. The asymmetrical design thus permits one mold to generate a package having two retail facings, a very useful feature, for it doubles the utility of a given package, effectively halving its cost.

Figure 9:
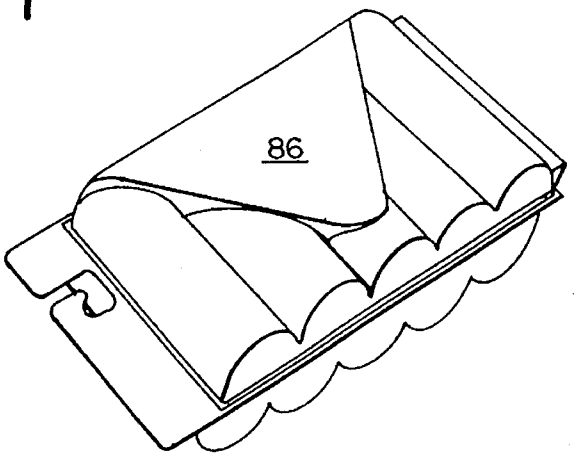
FIG. 9 illustrates a modification of the package of FIG. 8.

An alternative embodiment is shown in FIG. 9 wherein raised platform or recess 86 is triangularly shaped instead of semi-circularly as with the previous embodiment. The shape and size of recess 86 may be selected by placing inserts in the mold for the halves 12 and 14, as previously described, and is by no means limited to those shapes and sizes shown in the drawings. The flat surface of recess 86 can be given any convenient, aesthetic peripheral contour of any selected extension relative to the size of package 10. The size and shape of recess 86 may be partially determined by the product displayed in package 10. Should one desire to show more of the product, a long, narrow, rectangular shape may be given to recess 86 and to the corresponding insert flaps, for example. This variation in visual imagery permits a variety in packaging which is both visually pleasing and practical, for it permits product differentiation within the same general product line.

Figure 12:
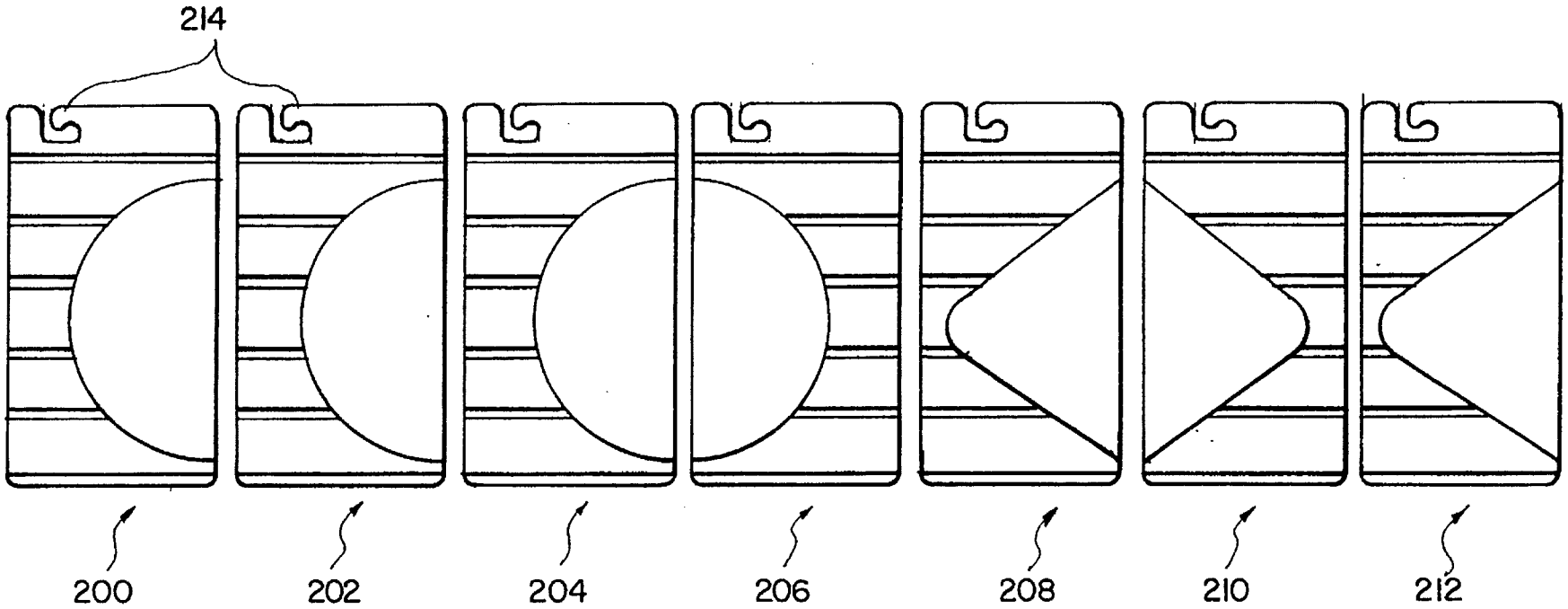
FIG. 12 illustrates several possible stock keeping units in accordance with the present invention.

Therefore, it should now be apparent that a central concept of the packaging system of the present invention is that it provides two package halves whose use is flexible at the retail level. This is illustrated in FIG. 12 which shows the front face of seven different packages 200–212 in accordance with the present invention. These seven packages 200–212 represent one possible planogram comprising seven SKUs (stock-keeping-units) for several different brands, styles and fabrics. For example, package 200 may be brand W's low rise briefs in cotton. Package 202 may comprise brand X's low rise briefs in cotton, while package 204 may comprise brand Y's low rise briefs in cotton. Package 206 may comprise brand Y's low rise briefs in nylon. Thus, it may be appreciated that the present invention may utilize the two package halves to differentiate between two fabrics for the same style of garment; i.e., packages 204 and 206 indicate respectively cotton and nylon low rise briefs for the same brand. Noteworthy also is the fact that packages 204 and 206 when displayed at retail present a visually pleasing appearance (that of a completed circle as shown in FIG. 12) and it has been found that the consumer soon becomes knowledgeable that package 204 contains cotton goods while package 206 contains nylon goods.

To continue the example, package 208 may comprise brand Y's bikini briefs in cotton, while package 2 10 may comprise brand Y's bikini briefs in nylon.. Again, the "front" half 12 of the package (package 208) is used to indicate cotton product, while the "front" half 14 of the package (package 210) is used to indicate nylon product. Finally, package 212 may be used to indicate brand Z's cotton bikini briefs.

It may further be appreciated, therefore, that the particular style or "silhouette" of these products may be differentiated by the shape of the package recess and insert (e.g., semi-circular for low rise briefs; triangular for bikini briefs). In addition, the size of the products contained within each package may be effectively differentiated by color coding printed on the insert. Thus, for example, green may be used for size small, red may be used for size medium, and blue may be used for size large.

It may be appreciated by virtue of the foregoing that by orienting the label shapes, at the point of purchase a planogram is created which organizes size of product by color coding, garment style by the shape of the insert, and garment fabrication by the orientation of the inserts relative to each other.

As stated previously, it is not necessary that the package halves be mirror images of one another. Referring now to FIG. 13A, there is illustrated a package having a product-receiving recess 100 comprising, in this example, four barrels 102, 104, 106 and 108 for receiving, holding and separating four pieces of apparel. Reference numeral 110A indicates an insert-receiving recess for containing an insert that comprises a rectangular portion 114A and a circular portion 116A which extends integrally from rectangular portion 114A along its lower edge. This shape of insert and recess may be chosen, for example, to indicate a low rise wrap style of garment. Note that the reverse J-hook 118 indicates that FIG. 13A illustrates the "front" of the package which, of course, is reinforced by the information printed on insert portions 114A and 116A.

Figure 13B:
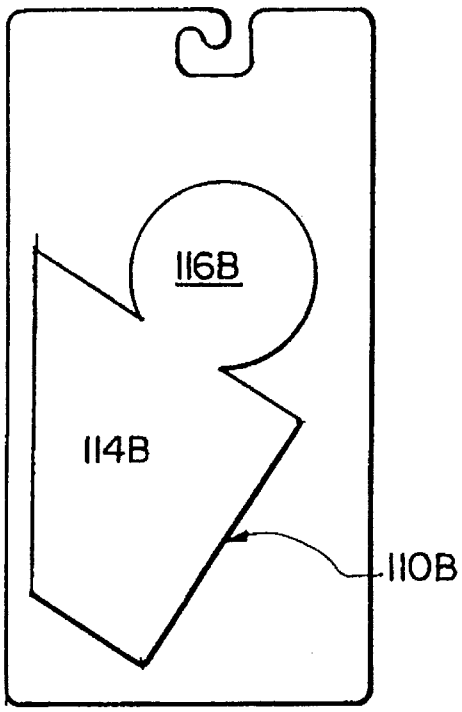
FIGS. 13A and 13B illustrate another embodiment of the present invention.
Figure 13A:
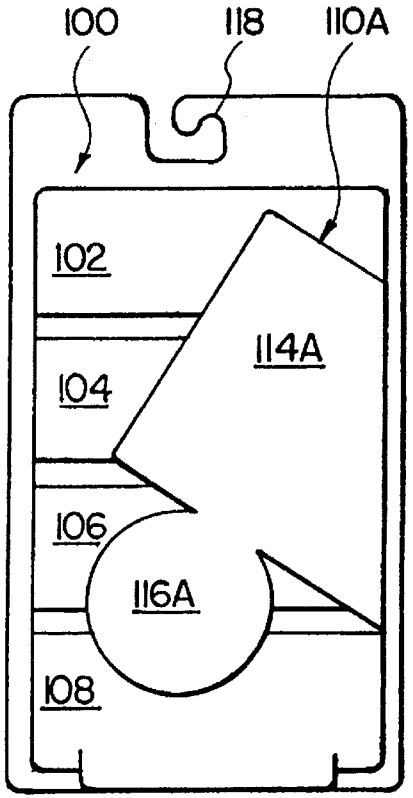

The "back" side of the same package is illustrated in FIG. 13B (illustration of the barrel portions has been omitted for the sake of simplicity). Reference numeral 110B indicates an insert-receiving recess for an insert comprising a rectangular portion 114B and a circular portion 116B that extends from an upper edge of rectangular portion 114B. Rectangular portion 114B is essentially a rectangular extension from portion 114A (the side flap portion that connects portions 114A and 114B is not shown in these views). It may be appreciated that the portion of the insert illustrated in FIG. 13B is "flopped" (rotated 180°) from the position of the insert shown in FIG. 13A.

Figure 14B:
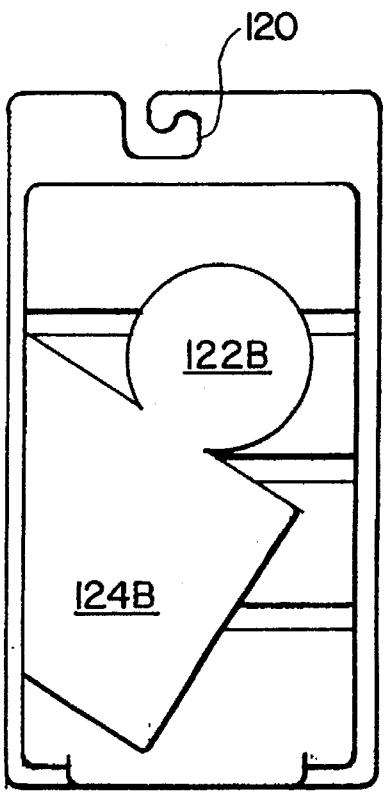
FIGS. 14A and 14B illustrate a further embodiment of the present invention.
Figure 14A:
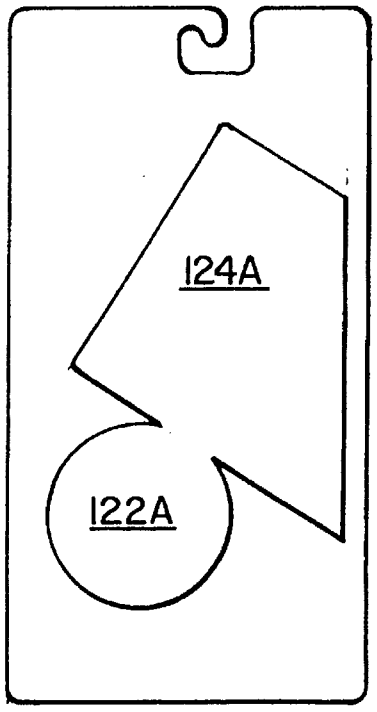

FIGS. 14A and 14B illustrate exactly the same clamshell halves as those shown in FIGS. 13A and 13B. In this case, however, the position of the reverse J-hook 120 indicates that FIG. 14B is the front of the package. The insert for the front of the package includes a rectangular portion 124B and a circular portion 122B extending from the upper edge of rectangular portion 124B. The positioning of the elements in FIG. 14B connotes a different style of garment, e.g., a low rise mesh. The rear of this package is illustrated in FIG. 14A.

Figure 15B:
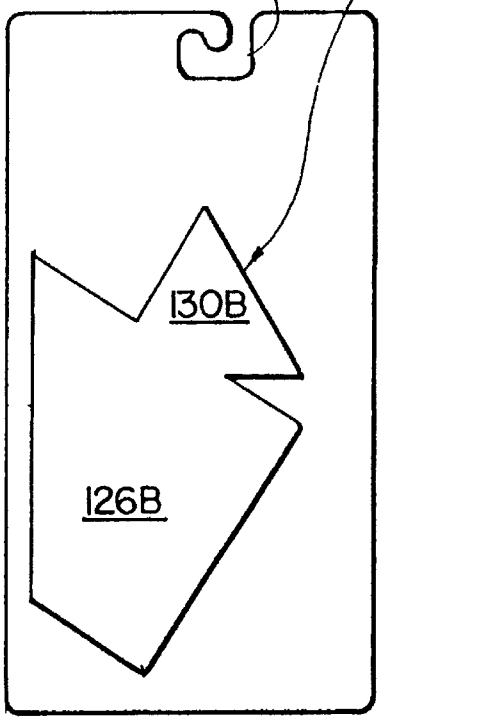
FIGS. 15A and 15B illustrate a still further embodiment of the present invention.
Figure 15A:
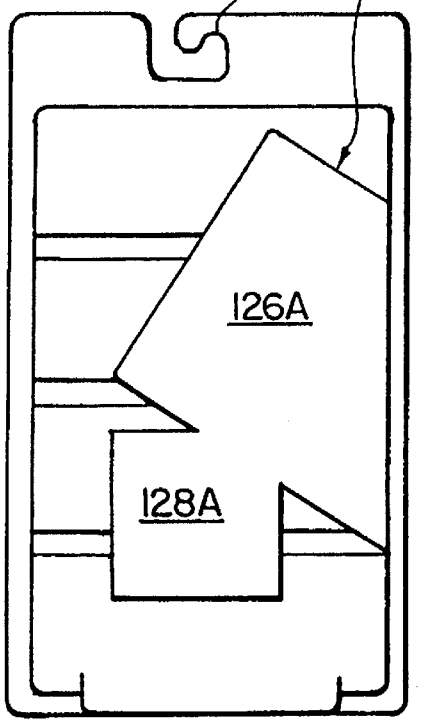

Referring now to FIGS. 15A and 15B, yet another embodiment of the present invention is illustrated wherein reverse J-hook 122 indicates that FIG. 15A is the front of this package. Reference numeral 124A refers to an insert-receiving recess comprising in this example a rectangular portion 126A and a square portion 128A extending from the lower edge thereof. This particular configuration may be selected to connote a fly front style of men's brief, for example. FIG. 15B illustrates the back of this same package and is seen to comprise a rectangular portion 126B which extends integrally from rectangular portion 126A on the front of the package by means of a side flap (not shown in this view). Extending from an upper edge of rectangular portion 126B is a triangular portion 130B.

Figure 16B:
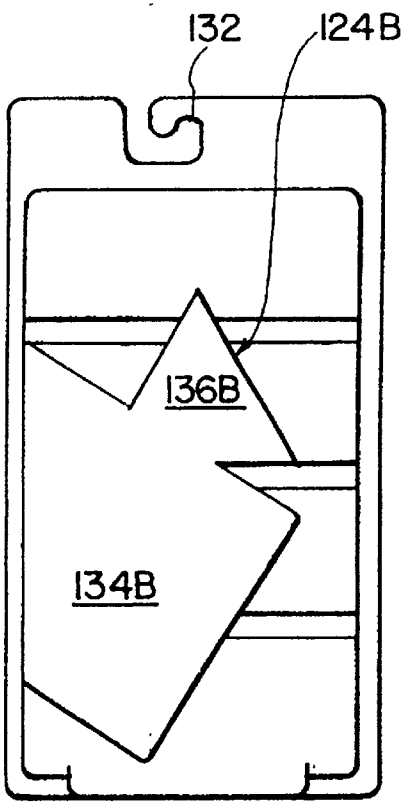
FIGS. 16A and 16B illustrate yet another embodiment of the present invention.
Figure 16A:
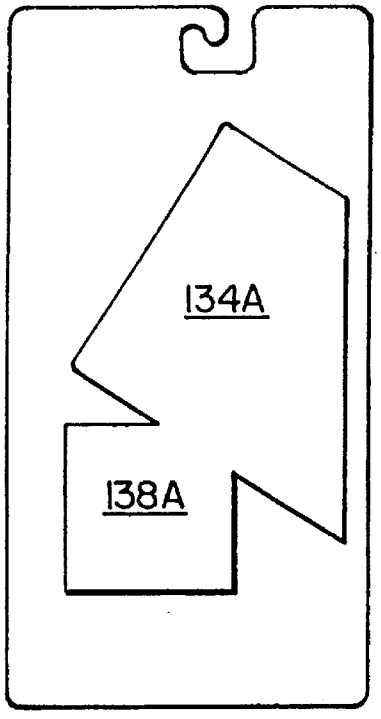

FIGS. 16A and 16B illustrate exactly the same clamshell package and insert-receiving recess design as shown in FIGS. 15A and 15B. However, the printing on the insert is changed to reflect the fact that FIG. 16B is now the front of the package. This is also mandated by selection of the reverse J-hook 132 formed in the header of the flange portion of the clamshell, as previously described. In this case, rectangular portion 134B extends integrally from portion 134A on the rear of the package (FIG. 16A), and triangular portion 136B extends from the upper edge of rectangular portion 134B. This particular facing can be chosen to connote another style of garment, e.g., a string bikini brief.

Of the foregoing examples, the front face of the inserts (shown in FIGS. 13A, 14B, 15A and 16B) typically illustrate a photo or sketch of the garment being worn by a model, a licensed logo, the product name, and other pertinent information. The back portions of the inserts (shown in FIGS. 13B, 14A, 15B and 16A) normally have information such as the UPC code, washing instructions, environmental information, and the like. The side flaps (not shown) may contain, for example, a size chart, the country of origin, style number, and other advantageous features.

Figure 17:
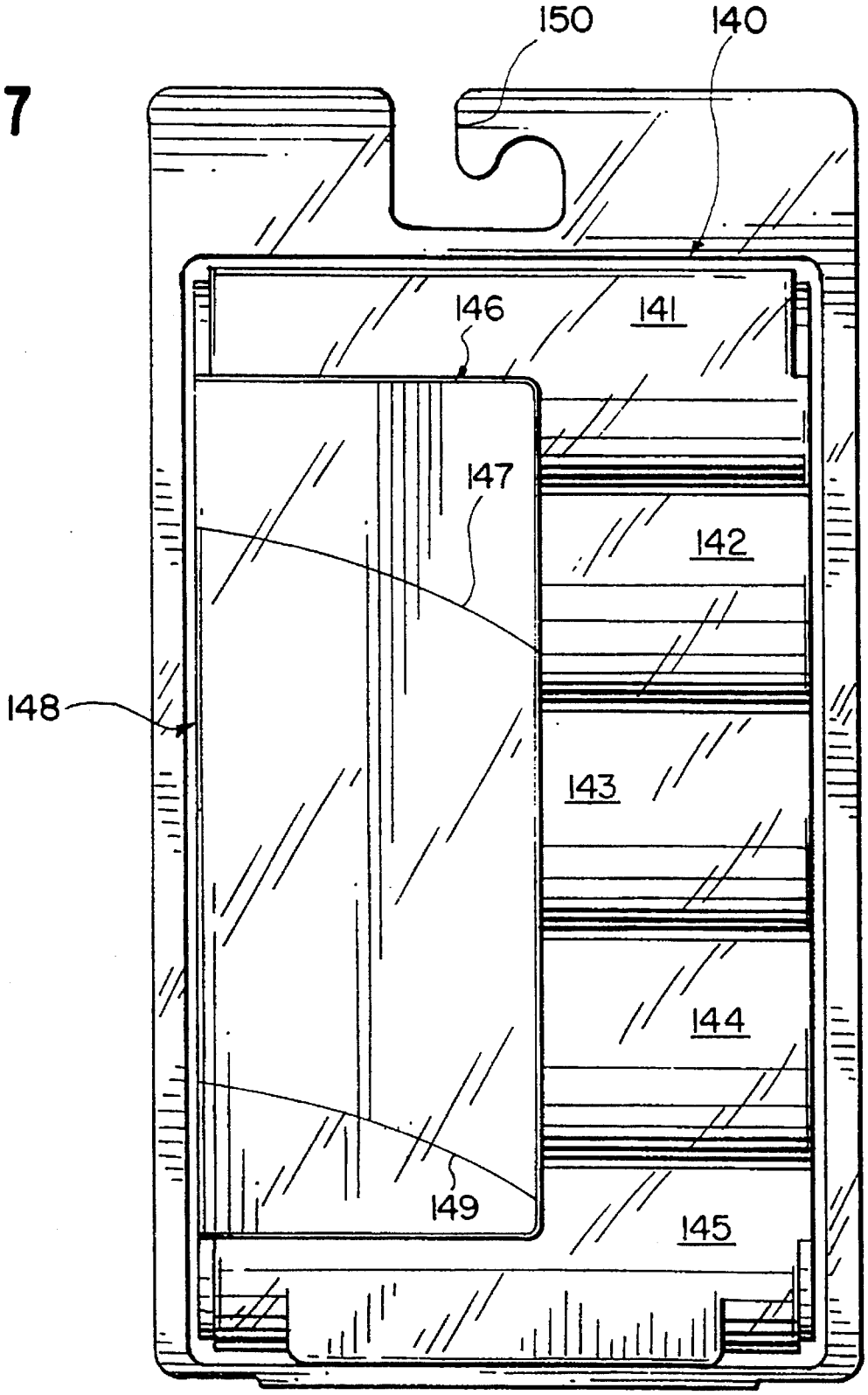
FIG. 17 shows another embodiment of the present invention.

Referring now to FIG. 17, there is illustrated yet another embodiment of the present invention wherein reference numeral 140 indicates generally a product-receiving recess which includes five barrel-shaped portions 141, 142, 143, 144 and 145. Reference numeral 146 indicates an insert-receiving recess which has located therein an insert 148 which includes curved top and bottom edges 147 and 149 which is chosen to connote, in this example, low rise men's briefs. The left-justification of insert 148, together with the reverse J-hook 150, indicate that we are looking at the front of the package and that the garments in the package are nylon.

Figure 18:
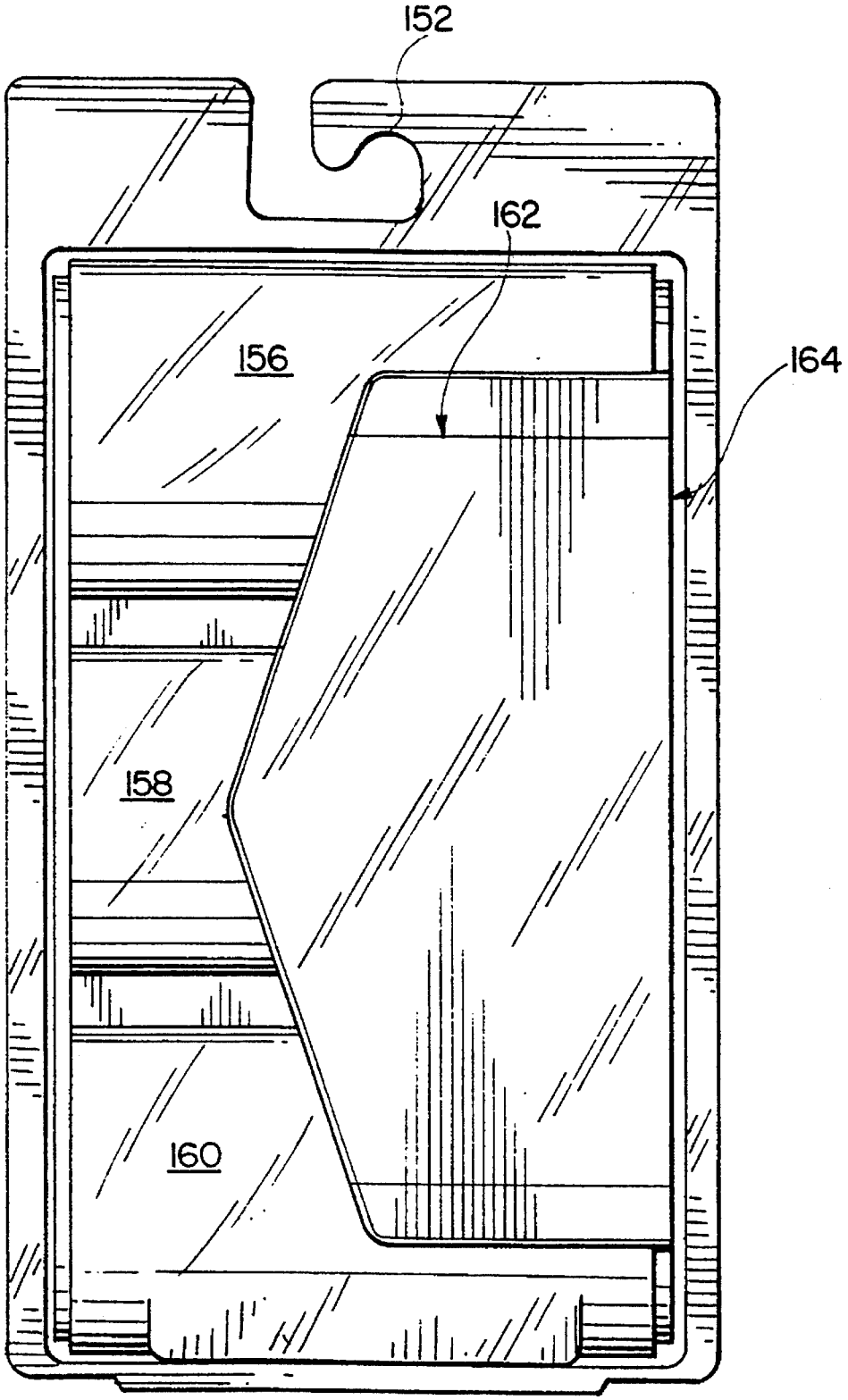
FIG. 18 illustrates a still further embodiment of the present invention.

Referring now to FIG. 18, there is illustrated another embodiment of the present invention wherein three barrels 156, 158 and 160 are provided for accommodating three pairs of garments. The insert-receiving recess 162 includes a somewhat triangularly shaped insert 164 which is used to connote men's string bikini briefs. The right-justification of insert 164, together with placement of the reverse J-hook 152, tells us that we are looking at the front of the package and that the contents of this particular package are cotton.

It may be appreciated by virtue of the foregoing that the present invention provides a novel and unique package and packaging system wherein the sculpture of the package and integrated insert shape provides the ability to differentiate at retail the garment style and fabric, all as a result of the geometry of the package. This greatly simplifies the retail store's housekeeping and restocking chores. Providing a color code on the insert for size, plus the orientation of the label's vertical edge, create a planogram so that the stock clerk (who need not read English) needs only to find the matching shape, orientation and color to keep the display housekept during the day and to restock the display as the product arrives.

The packaging system of the present invention is flexible enough to accommodate a wide variety of garments, quantities, styles, colors, patterns, sizes and brands. Mold cost is minimized since the same mold with the same recessed platform can be used not only for two different fabrics of the same style, but for many different styles using different recessed platforms by simply using inserts in the basic package mold. The inserts may be mirrored, "flopped" or face-specific to assist both the consumer and the stock clerk. A planogram in accordance with the present invention facilitates both consumer selection and stock keeping. The sealed package of the present invention effectively prevents the package from being opened prior to purchase, thereby minimizing "damaged goods". The net result is a package that looks product specific, brand specific and silhouette specific.

Those skilled in the art will appreciate that the conception, upon which this disclosure is based, may readily be utilized as a basis for the designing of other structures, methods and systems for carrying out the several purposes of the present invention. For example, the barrel-shaped segments can be made of differing shapes and sizes to accommodate other, diverse products. It is important, therefore, that the claims be regarded as including such equivalent constructions insofar as they do not depart from the spirit and scope of the present invention as defined in the appended claims.

Further, the purpose of the following Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

Numerous modifications and variations of the present invention are possible in light of the above teachings. It is therefore to be understood that within the scope of the appended claims the invention may be practiced otherwise than as specifically described herein.

I claim as my invention:

1. A package for a plurality of pairs of intimate apparel, comprising:

a first half and a second half each having an integral flange extending about the periphery thereof and being integrally connected to each other along one edge by a hinge;

each of said halves comprising a dished out portion having a product receiving portion and an insert-receiving recess overlying said product receiving portion;

said insert-receiving recess in each of said halves having a peripheral contour;

an insert comprising a front flap, a back flap, and a side flap integrally connecting said front flap and said back flap, said insert being positioned within the insert-receiving recesses of said first and second halves without being adhesively secured therein, said insert adapted to be retained in said insert-receiving recesses by the natural expansion of said plurality of pairs of intimate apparel contained within said package when said first and second halves are closed; and said package being molded of a transparent, semi-flexible plastic material.

2. The package as set forth in claim 1, wherein said front and back flaps of said insert have the same general shape as said insert-receiving recesses in said first and second halves, respectively.

3. The package as set forth in claim 2, wherein said front and back flaps of said insert are shaped similarly to one another.

4. The package as set forth in claim 3, wherein said front and back flaps are semicircular.

5. The package as set forth in claim 3, wherein said front and back flaps are triangular.

6. The package as set forth in claim 3, wherein said front and back flaps are rectangular.

7. The package as set forth in claim 3, wherein said front and back flaps are polygonal.

8. The package as set forth in claim 3, wherein said front and back flaps comprise a portion of a rectangle and a polygon.

9. The package as set forth in claim 8, wherein said polygon comprises a square.

10. The package as set forth in claim 3, wherein said front and back flaps comprise a portion of a rectangle and a circle.

11. The package as set forth in claim 10, wherein said back flap is 180 degrees rotated with respect to said front flap.

12. The package as set forth in claim 2, wherein said front and back flaps of said insert are shaped differently from one another.

13. The package as set forth in claim 12, wherein said front flap comprises a portion of a rectangle and a square, and said back flap comprises a portion of a rectangle and a triangle.

14. The package as set forth in claim 13, wherein said back flap is 180 degrees rotated with respect to said front flap.

15. The package as set forth in claim 1, wherein said front flap and said back flap of said insert have a periphery of a particular geometric shape whereby said particular geometric shape represents a particular style of product.

16. The package as set forth in claim 15, wherein said insert-receiving recesses in said first and second halves of said package are shaped to accommodate said particular geometric shape of said front and back flaps of said insert.

17. The package as set forth in claim 1, further comprising indicia means for differentiating between a plurality of sizes of product for said package, said indicia means comprising a visually discerable color carried by said flaps of said insert, said color representing a product of a particular size.

18. The package as set forth in claim 1, wherein said insert-receiving recess includes a side edge that is formed contiguously with a side edge of said dished out portion.

19. The package as set forth in claim 18, further comprising means for indicating a first fabric or a second fabric for said product, said means for indicating comprising using said first half or said second half of said package, respectively, as the front of said package.

20. The package as set forth in claim 19, wherein said means for indicating a first fabric or a second fabric further comprises a reverse J-hook formed on a portion of said integral flange, whereby the orientation of said reverse J-hook determines the front of said package.

21. The package as set forth in claim 1, wherein said side flap of said insert is located on the side of said package when said first and second halves are closed.

22. The package as set forth in claim 1, wherein said product receiving portion comprises a plurality of segments for separating and retaining said plurality of pairs of intimate apparel.

23. The package as set forth in claim 22, wherein said plurality of pairs of intimate apparel are individually folded or rolled prior to insertion into said package, and wherein said plurality of segments form a plurality of juxtaposed cylinders, whereby each of said cylinders receive, separate and support one of said pairs of intimate apparel.

24. The package as set forth in claim 1, wherein said flange includes a header defining the top of said package, said header having a J-shaped slot formed therein for hanging said package on a peg.

25. The package as set forth in claim 24, wherein the front of said package may comprise either said first half or said second half, said front being defined by whichever of said first half or said second half of said package has said J-shaped slot appearing reversed.

26. The package as set forth in claim 1, further comprising a pair of support surfaces molded into said first and second halves adjacent said hinge, such that said package may be stood upright on a support surface.

27. The package as set forth in claim 1, wherein said flanges of said first and second halves are heat-sealed.

28. The package as set forth in claim 27, wherein said halves are heat sealed by radio frequency sealing and then die cut.

29. The package as set forth in claim 1, wherein said first and second halves have a sidewall, and said peripheral contour of each of said recesses includes a sidewall that is contiguous with said sidewall of said first and second halves, and said recess has a geometrical shape selected from the group consisting of rectangular, semicircular, triangular and polygonal.

30. The package as set forth in claim 29, wherein said side flap lies adjacent a sidewall of said first and second halves when closed, and said periphery of each of said front and back flaps correspond to the peripheral contour of said recesses.

31. A package molded of a transparent, semi-flexible plastic material for housing a plurality of pairs of intimate apparel, comprising:

a first half and a second half each having an integral flange extending about the periphery thereof and being integrally connected to each other along one edge by a hinge;

each half comprising a dished out portion having a product receiving portion and an insert-receiving recess overlying said product receiving portion;

said insert-receiving recess having a preselected peripheral contour;

an insert comprising a front flap, a back flap, and a side flap integrally connecting said front flap and said back flap, said insert being positioned within said recess of each half without being adhesively secured therein, said insert adapted to be retained in said recess of each half by the natural expansion of said plurality of pairs of intimate apparel contained within said package when said first half and second half are closed; and means for selecting whether said first half or said second half of said package is the front of said package.

32. The package as set forth in claim 31, wherein said selecting means comprises a reverse J-hook formed on a portion of said integral flange.

33. A system for packaging a plurality of pairs of intimate apparel of various styles, colors, sizes, and fabrics, comprising:

a first half and a second half molded of a transparent, semi-flexible plastic material;

each half comprising a dished out portion having a product receiving portion and an insert-receiving recess overlying said product receiving portion;

a plurality of inserts each having a front flap, a back flap, and a side flap integrally connecting said front flap and said back flap, wherein said front flap and said back flap of said insert have a periphery of a particular geometric shape whereby said particular geometric shape represents a particular style of product.

34. The packaging system as set forth in claim 33, wherein one of said inserts is adapted to be positioned within said recess of each half without being adhesively secured therein, said insert being retained in said recess of each half by the natural expansion of said plurality of pairs of intimate apparel contained within said package when each half is closed.

35. The packaging system as set forth in claim 33, wherein said front flap and said back flap are shaped the same.

36. The packaging system as set forth in claim 33, wherein said front flap and said back flap are shaped differently.

37. The packaging system as set forth in claim 33, wherein the front of said package may comprise either said first half or said second half of the package.

38. The packaging system as set forth in claim 37, further comprising flanges formed about the periphery of said first half and said second half, said flanges including a header portion formed at the top of the package.

39. The packaging system as set forth in claim 37, further comprising a reverse J-hook formed in said header portion to indicate said front of said package.

* * * * *